US008956179B2

(12) United States Patent
MacDougall

(10) Patent No.: US 8,956,179 B2
(45) Date of Patent: Feb. 17, 2015

(54) RECEPTACLE CONNECTOR WITH DETECTION FUNCTION

(71) Applicant: Advanced-Connectek Inc., New Taipei (TW)

(72) Inventor: Alan MacDougall, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 67 days.

(21) Appl. No.: 13/953,215

(22) Filed: Jul. 29, 2013

(65) Prior Publication Data

US 2014/0302708 A1 Oct. 9, 2014

(30) Foreign Application Priority Data

Apr. 3, 2013 (TW) ..... 102206139 U

(51) Int. Cl.
*H01R 3/00* (2006.01)
*H01R 13/641* (2006.01)
*H01R 12/72* (2011.01)

(52) U.S. Cl.
CPC ..... *H01R 13/641* (2013.01); *H01R 12/724* (2013.01)
USPC ..... 439/489; 439/660

(58) Field of Classification Search
CPC ..... H01R 13/641; H01R 12/724
USPC ..... 439/79, 188, 488–490, 607.35–607.4, 439/660
See application file for complete search history.

(56) References Cited

U.S. PATENT DOCUMENTS

| | | | | |
|---|---|---|---|---|
| 7,517,253 | B1 * | 4/2009 | Chiang | 439/660 |
| 8,109,795 | B2 * | 2/2012 | Lin et al. | 439/660 |
| 8,882,540 | B2 * | 11/2014 | Yen et al. | 439/607.27 |

FOREIGN PATENT DOCUMENTS

| | | |
|---|---|---|
| TW | M422185 | 2/2012 |
| TW | M426190 | 4/2012 |
| TW | M441957 | 11/2012 |

* cited by examiner

*Primary Examiner* — Khiem Nguyen
(74) *Attorney, Agent, or Firm* — patenttm.us

(57) ABSTRACT

A receptacle connector has an insulator, multiple contacts, a shell, an insulating bracket, and a detection contact. The shell covers the insulator and the contacts and has a cavity to receive the insulator and the contacts. A detection arm is formed on one of two sidewalls of the shell, which is resilient and able to be deformed by external force and recovered after removal of the external force. The insulating bracket is mounted outside of one of the sidewalls of the shell and has mounting slot defined in the insulating bracket. The detection contact is mounted in the mounting slot of the insulating bracket and is capable of contacting the detection arm. When a plug connector is inserted into the receptacle connector, the detection arm is bent to contact the detection contact for detecting the existence of the plug connector and activating signal transmission or power supply.

10 Claims, 11 Drawing Sheets

RECEPTACLE CONNECTOR WITH DETECTION FUNCTION

BACKGROUND OF THE INVENTION

1. Field of the Invention

The present invention relates to an electrical connector, and more particularly, to a receptacle connector with detection contact which is adapted to be compatible with the receptacle connector without requiring modification of construction of an insulator. In other words, it is not necessary to change the shape of the insulator for installing the detection contact into the receptacle connector. The detection contact is located and fitted outside a shell of the receptacle connector to enable signal transmission or power supply when a plug connector is inserted into the receptacle connector, or to achieve other detection purposes, such as hot plug detection, accessory identification.

2. Description of Related Art

A universal serial bus (USB) receptacle connector is generally mounted on a printed circuit board (PCB) of electronic devices such as desktop or laptop computers. The universal serial bus (USB) receptacle connector further comprises power contacts which are utilized to provide the power to external accessory devices. When operating in a power saving mode, the motherboard disconnects the power supply to most accessory devices or interface cards, including disconnecting the power supply to USB receptacle connectors. Power saving modes are reduced power modes that use less power than full power modes. In power saving mode, most device functions are not available.

However, some users expect that the motherboard still is able to enable signal transmission, power supply or other detection functions between USB receptacle connectors and USB plug connectors when the motherboard enters the saving mode and a plug connector is inserted into the receptacle connector.

Taiwan patent application No. 100205057 discloses a USB receptacle connector having an insulator, multiple first contacts, multiple second contacts and a shell. A ground contact of the first contacts has a detection arm protruding from a central portion of the ground contact of the first contacts. The central portion of the ground contact has a hole which is configured to receive the detection arm because of the detection arm's protruding nature when a connector insert of a male plug connector is inserted into the receptacle connector to form connection. The detection arm extends along a protruding direction of a tongue of the insulator and has a contact portion departing from a base of the insulator. There is a slot in central top surface of the protruding tongue, which is configured to receive the detection arm, and the detection arm is exposed through the hole. When a connector insert of a male plug connector is inserted into the receptacle connector to form connection, the detection arm contacts and presses against a shell of the plug connector, and a resilient tab of the shell of the plug connector also contacts the shell of the receptacle connector. Therefore, after the insertion of the plug connector, the detection arm substantially contacts the shell of the receptacle connector electrically and thus establishes an electrical connection between the shell of the receptacle connector and the detection arm. Furthermore, through pins of the shell of the receptacle connector, it also can establishes an electrical connection between the motherboard and the detection arm. However, forming a thinner detection arm on the thin and elongated ground contact of the first contacts requires precise processes so that manufacturing such detection arm is difficult and production rate thereof is low. Furthermore, the insulator needs to be customized to have the receiving slot.

Taiwan patent application No. 100216268 discloses a receptacle connector having an insulator, multiple conductive contacts, a detection contact, and a conductive shell. The insulator has an installation slot. The detection contact is mounted in the installation slot. The conductive shell has a detection resilient tab formed thereon and corresponding to the detection contact. When a plug connector is inserted into the receptacle connector, the detection contact contacts the detection resilient tab so that the receptacle connector detects and supplies power to the plug connector. The insulator needs to be customized to form the installation slot for receiving the detection contact.

Taiwan patent application No. 101209329 discloses a receptacle connector having an insulator, multiple conductive contacts, a detection contact, and a shell. The insulator has a mounting slot defined therein. One of the conductive contacts is a ground contact. The detection contact is mounted in the mounting slot and selectively contacts or separates from the ground contact for detection whether an external plug connector is inserted into the receptacle connector. However, the insulator still needs to be customized to have the mounting slot for receiving the detection contact.

To overcome the shortcomings, the present invention provides a receptacle connector with detection function to mitigate or obviate the aforementioned problems.

SUMMARY OF THE INVENTION

The main objective of the invention is to provide a receptacle connector with detection function that needs no modification to the construction of an insulator for installation of a detection contact. The receptacle connector has a detection contact located and fitted outside a shell to ensure that signal transmission, power supply, accessory identification, or other detection purposes is activated when a plug connector is inserted into the receptacle connector.

A receptacle connector in accordance with the present invention has an insulator, multiple contacts, a shell, an insulating bracket and a detection contact. The shell covers the insulator and the contacts, which has a cavity to receive the insulator and the contacts. A detection arm is formed on one of two sidewalls, which is resilient and able to be deformed by external force and recovered after removal of the external force. The insulating bracket is mounted outside of one of the sidewalls of the shell and has a mounting slot defined in the insulating bracket. The detection contact is mounted in the mounting slot of the insulating bracket and is capable of contacting the detection arm. When a plug connector is inserted into the receptacle connector, the detection arm is bent to contact the detection contact for detecting the existence of the plug connector and activating signal transmission, power supply, or other purposes.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
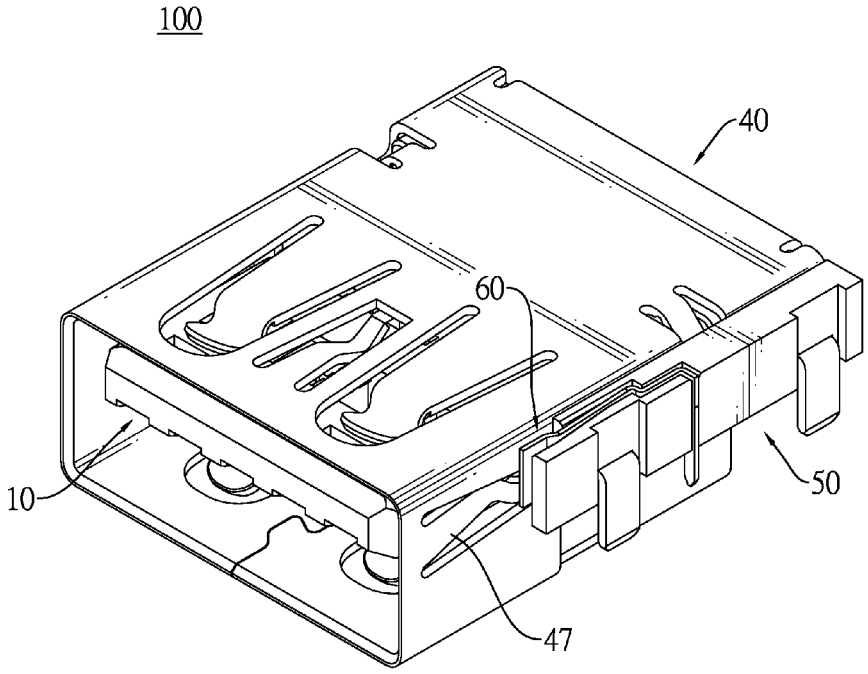
FIG. 1 is a perspective view of a first embodiment of a receptacle connector with detection function in accordance with the present invention.
Figure 2:
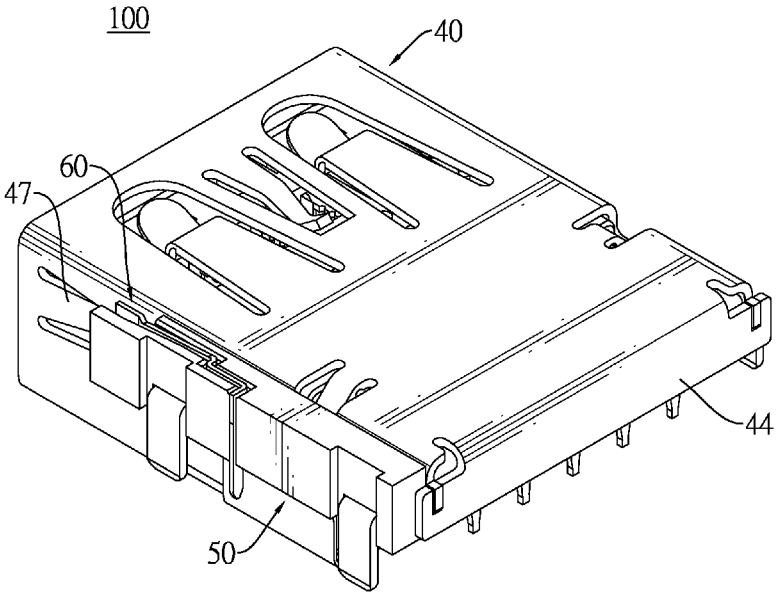
FIG. 2 is another perspective view of the receptacle connector in FIG. 1.
Figure 3:
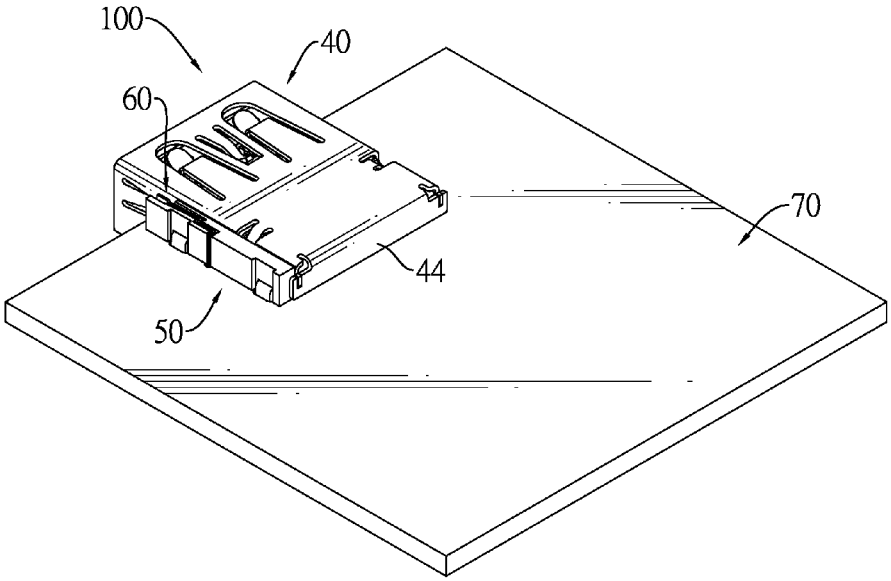
FIG. 3 is a perspective view of the receptacle connector in FIG. 1 mounted on a PCB.

FIGS. 1 to 3 and 5 illustrate a first embodiment of a receptacle connector 100 with detection function in accordance with the present invention. Although the drawings of the first embodiment depicts a Drop-in (Mid-mount) type receptacle connector 100, the receptacle connector with detection function is not limited to be used as a Drop-in (Mid-mount) type receptacle connector and may be used as a standard (bottom mount) type receptacle connector or other receptacle connector. In this embodiment, the receptacle connector 100 may be mounted on a PCB (printed circuit board) 70 and comprises an insulator 10, multiple contacts 20, 30, a shell 40, an insulating bracket 50, and a detection contact 60.

Figure 4:
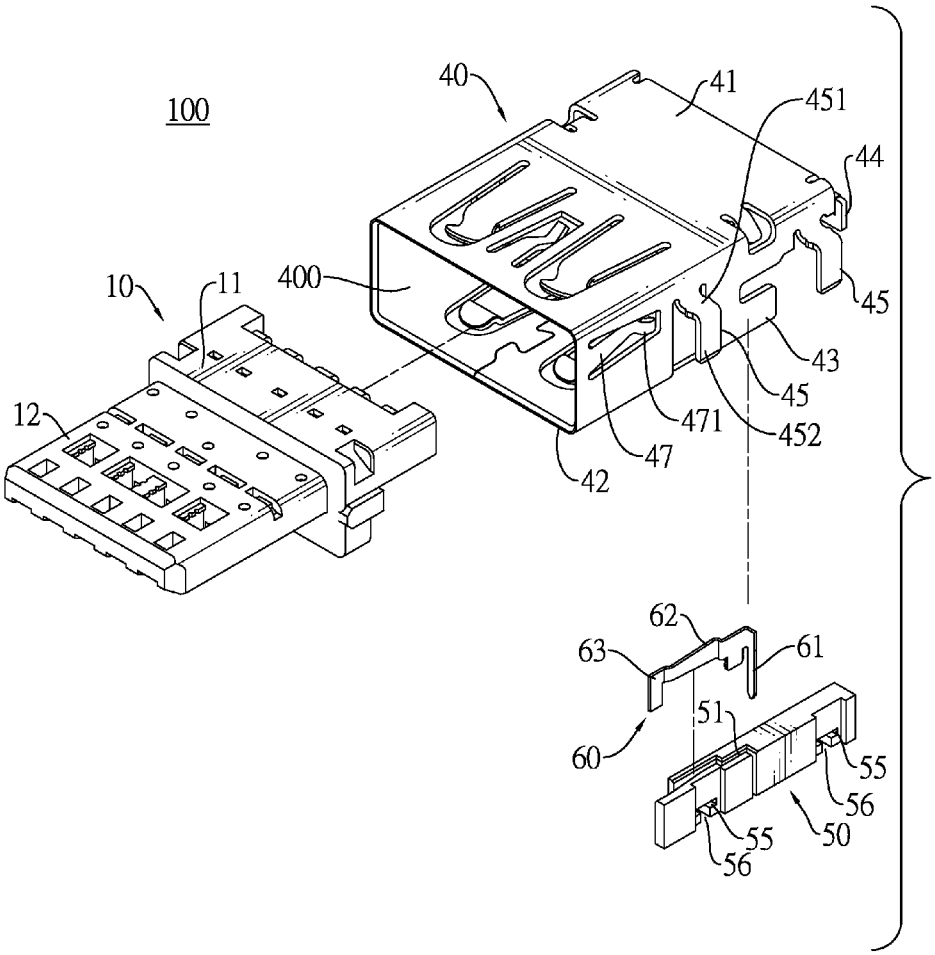
FIG. 4 is an exploded perspective view of the receptacle connector in FIG. 1.
Figure 5:
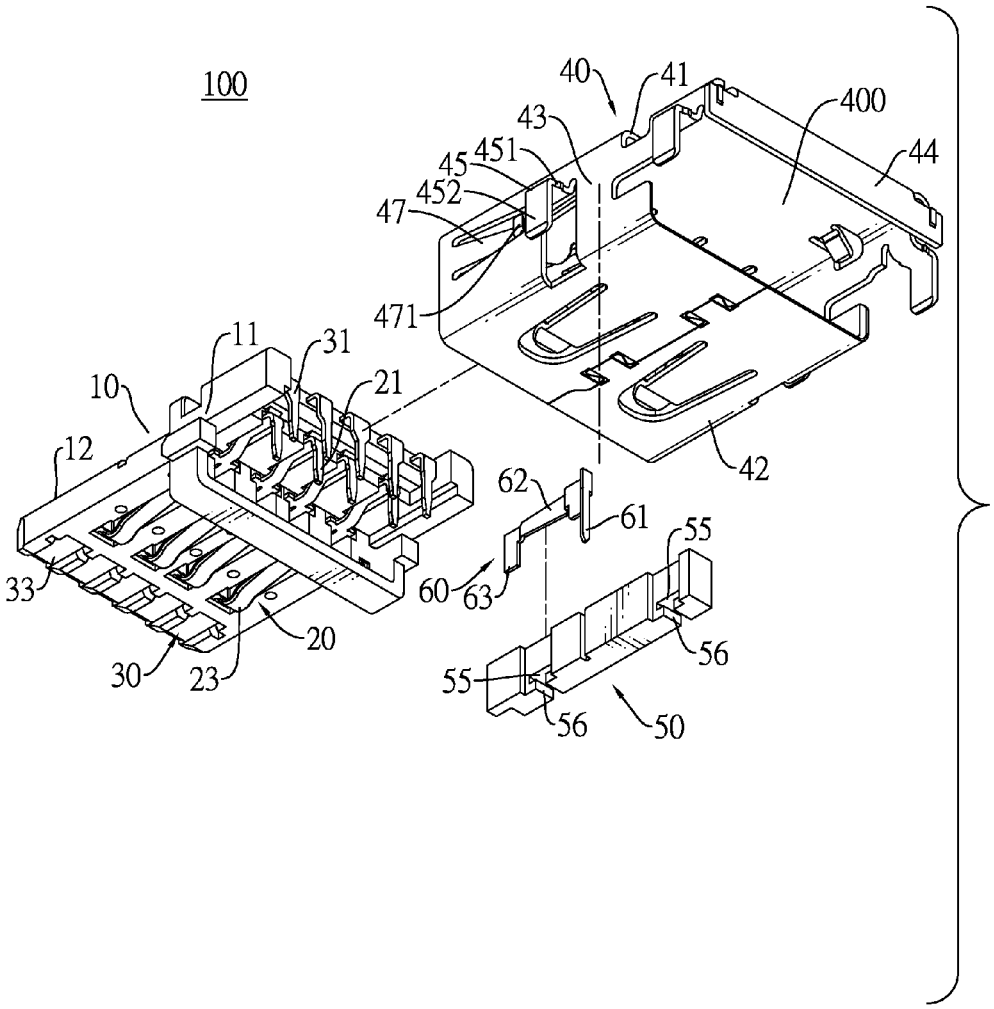
FIG. 5 is another exploded perspective view of the receptacle connector in FIG. 1.

With further reference to FIGS. 4 and 5, the insulator 10 has a base 11 and a tongue 12 formed on and protruding forward from the base 11. The insulator 10 has a plurality of contact locations, where contacts 20, 30 are located on.

Each contact 20, 30 individually has a soldering section 21, 31 and an electrical contact section 23, 33. The soldering sections 21, 31 are located behind a rear end of the base 11 and may be soldered or mounted by other means on the PCB 70. The electrical contact sections 23, 33 are individually formed on the soldering sections 21, 31 and are located on the contact locations of the tongue 12. Furthermore, the contacts 20, 30 may be classified into multiple first contacts 20 and multiple second contacts 30 that comply with USB 3.0 protocol. The second contacts 30 are located above the first contacts 20.

The shell 40 covers the insulator 10 and the contacts 20, 30 and a cavity 400 lie inside the shell 40 which is configured to receive the insulator 10 and the contacts 20, 30. The shell 40 further has a top plate 41, a bottom plate 42, two opposite sidewalls 43, a conductive cap 44, a detection arm 47, and multiple electrical contact mounts 45, wherein the conductive cap 44 is used to isolate the connector's contact from interference. The sidewalls 43 are formed between the top plate 41 and bottom plate 42. The conductive cap 44 is formed on a rear end of the top plate 41 and protrudes downward from the rear end of the top plate 41 so as to cover the soldering sections 21, 31 of the contacts 20, 30 to prevent electromagnetic interference. The detection arm 47 is resilient and is able to be deformed by external force and recovered after removal of the external force. The detection arm 47 is formed on one of the sidewalls 43 of the shell 40 and has an electrical contact portion 471 formed on a distal end of the detection arm 47. The electrical contact mounts 45 are formed on one of the sidewalls 43 of the shell 40. Each electrical contact mount 45 could be approximately or exactly L-shaped which has a level section 451 and a perpendicular section 452 formed on the level section 451 and protruding downward from the level section 451.

Figure 6:
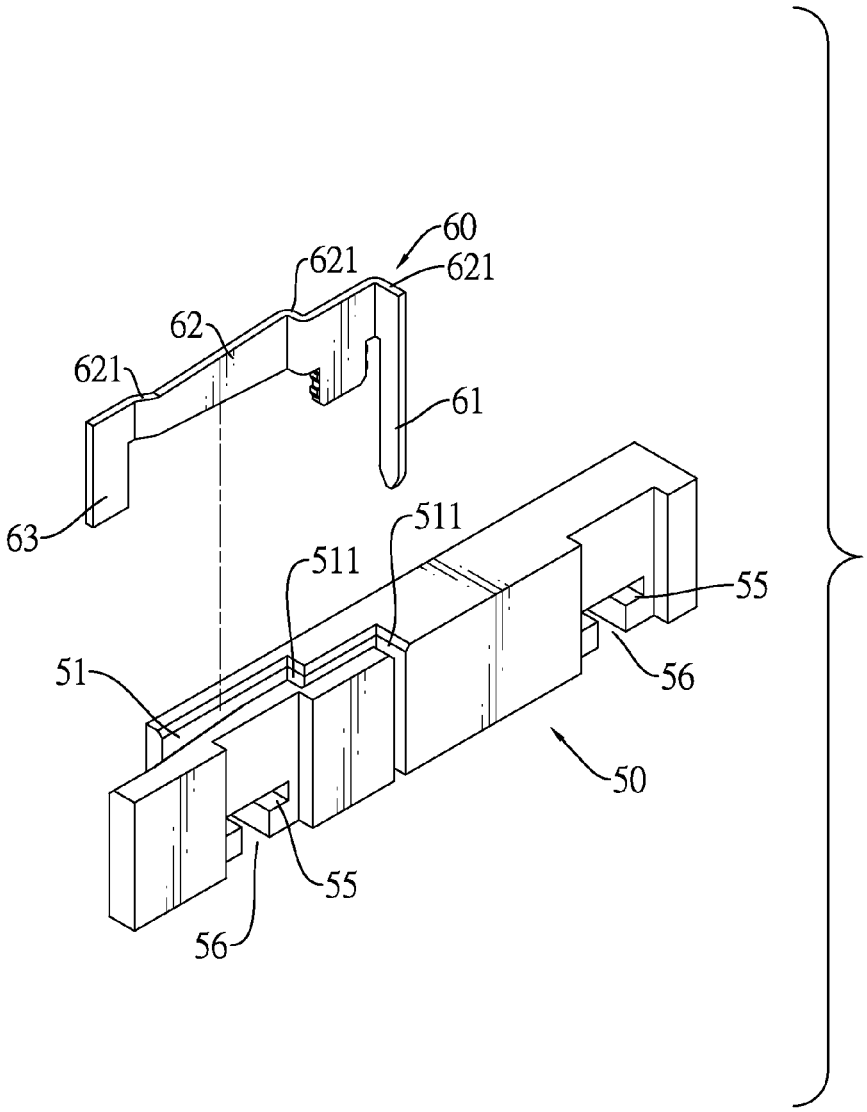
FIG. 6 is an exploded perspective view of an insulating bracket and a detection contact of the receptacle connector in FIG. 1.

With further reference to FIG. 6, the insulating bracket 50 is mounted outside one of the sidewalls 43 of the shell 40 and has a mounting slot 51, multiple through holes 55, and multiple open fixture slots 56. The mounting slot 51 is defined through in the insulating bracket 50 and has multiple corner spaces 511. The through holes 55 are defined through the insulating bracket 50 and the level sections 451 of the electrical contact mounts 45 are mounted respectively through the through holes 55. The open fixture slots 56 are defined in a bottom of the insulating bracket 50 which correspond to the through holes 55 and communicate respectively with the through holes 55.

The detection contact 60 is mounted in the mounting slot 51 of the insulating bracket 50 and is capable of contacting the detection arm 47. The detection arm 47 may be deformed by external force to contact the detection contact 60. The detection contact 60 has a soldering leg 61, a mounting segment 62 and an electrical contact segment 63. The soldering leg 61 is mounted through the insulating bracket 50. The mounting segment 62 is connected to the soldering leg 61 and has multiple folding portions 621 mounted respectively in the corner spaces 511 of the mounting slot 51 of the insulating bracket 50. The electrical contact segment 63 is connected to the mounting segment 62 and selectively contacts the electrical contact portion 471 of the detection arm 47. When a corresponding plug connector is inserted completely into the receptacle connector 100, the detection arm 47 is deformed and bent outward by external force so that the electrical contact portion 471 of the detection arm 47 touches the electrical contact segment 63 of the corresponding detection contact 60. When the plug connector is pulled out of and separated from the receptacle connector 100, the detection arm 47 is recovered to its original shape due to removal of the external force so that the electrical contact portion 471 of the detection arm 47 is separated from the electrical contact segment 63 of the detection contact 60.

Figure 7:
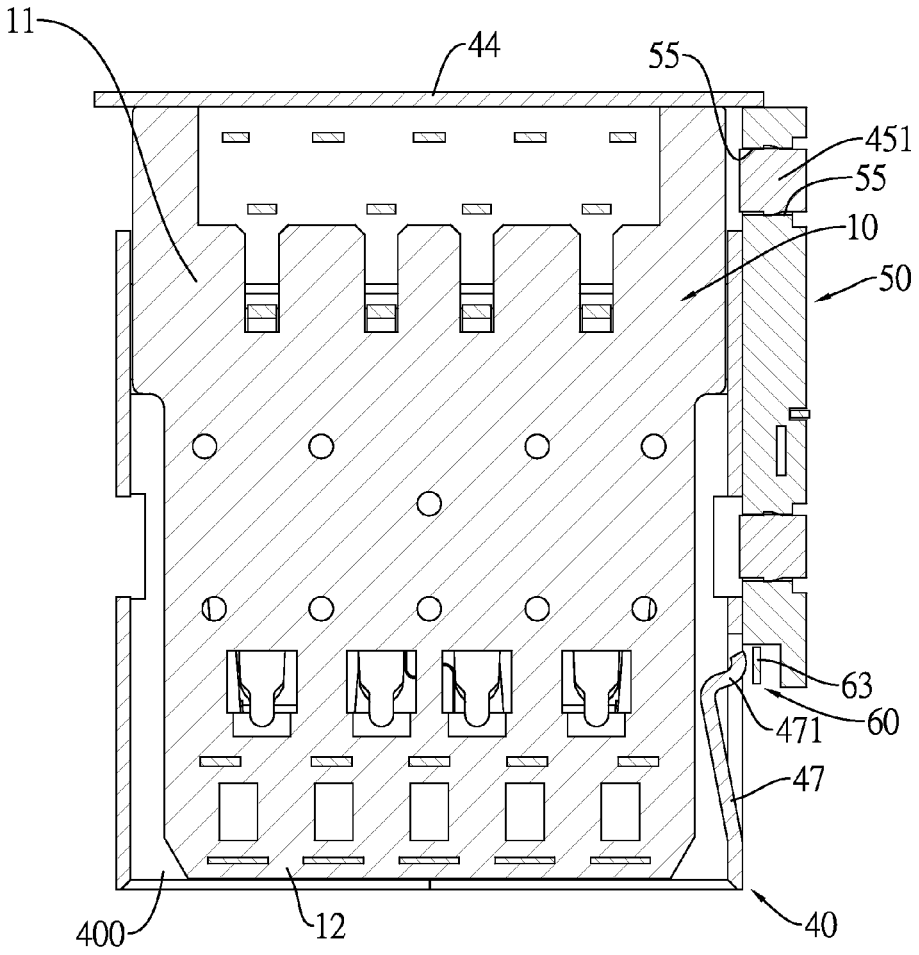
FIG. 7 is a cross sectional top view of the receptacle connector in FIG. 1.

With further reference to FIG. 7, the electrical contact portion 471 of the detection arm 47 is separated from the electrical contact segment 63 of the detection contact 60 when no plug connector is inserted into the receptacle connector 100.

Figure 8:
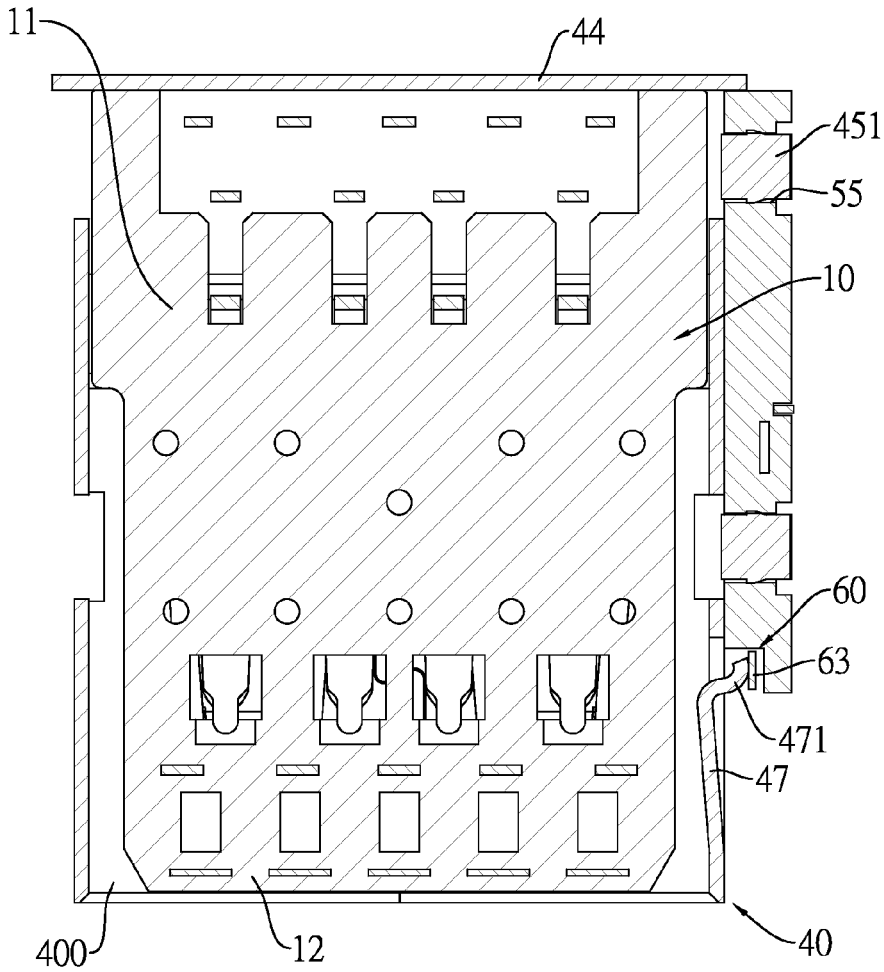
FIG. 8 is an operational cross sectional top view of a plug connector inserted into the receptacle connector in FIG. 7.

With further reference to FIG. 8, a plug connector presses against and forces the detection arm 47 to bend outward when the plug connector is inserted into the receptacle connector 100 so that the electrical contact portion 471 of the detection arm 47 contacts the electrical contact segment 63 of the detection contact 60 which is outside the shell 40. Accordingly, the receptacle connector 100 is able to detect the plug connector and choose to activate signal transmission to the plug connector, to activate power supply to the plug connector, or to achieve other detection functions.

Figure 9:
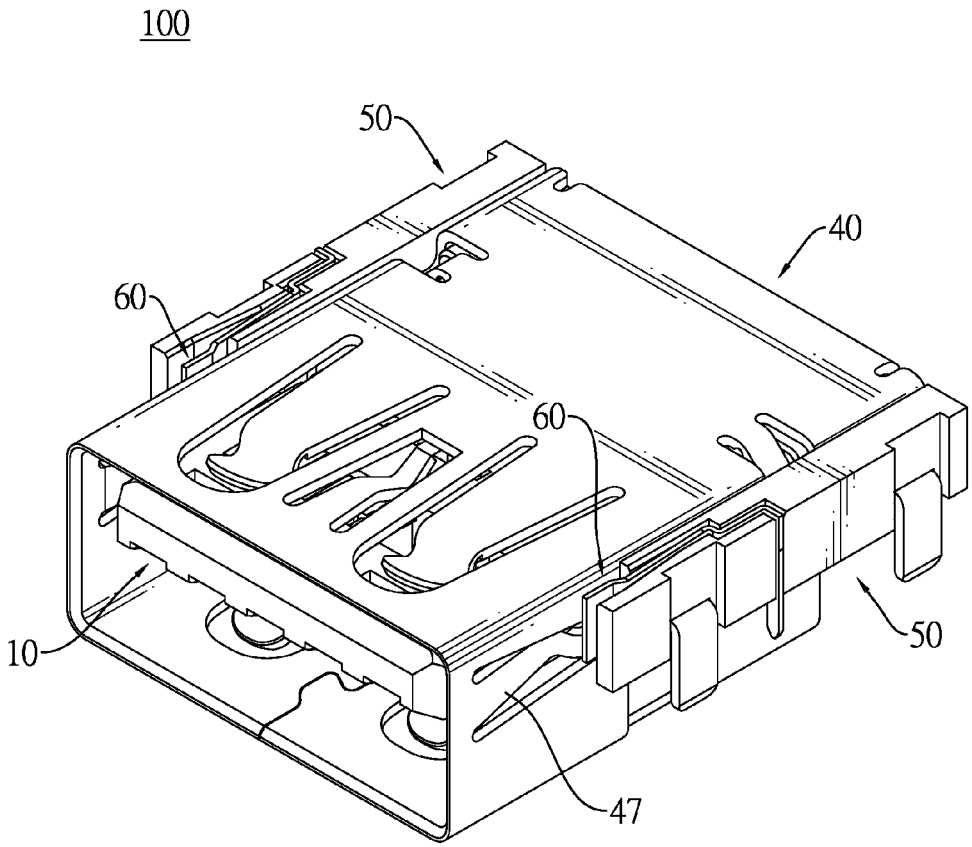
FIG. 9 is a perspective view of a second embodiment of the receptacle connector in accordance with the present invention.
Figure 10:
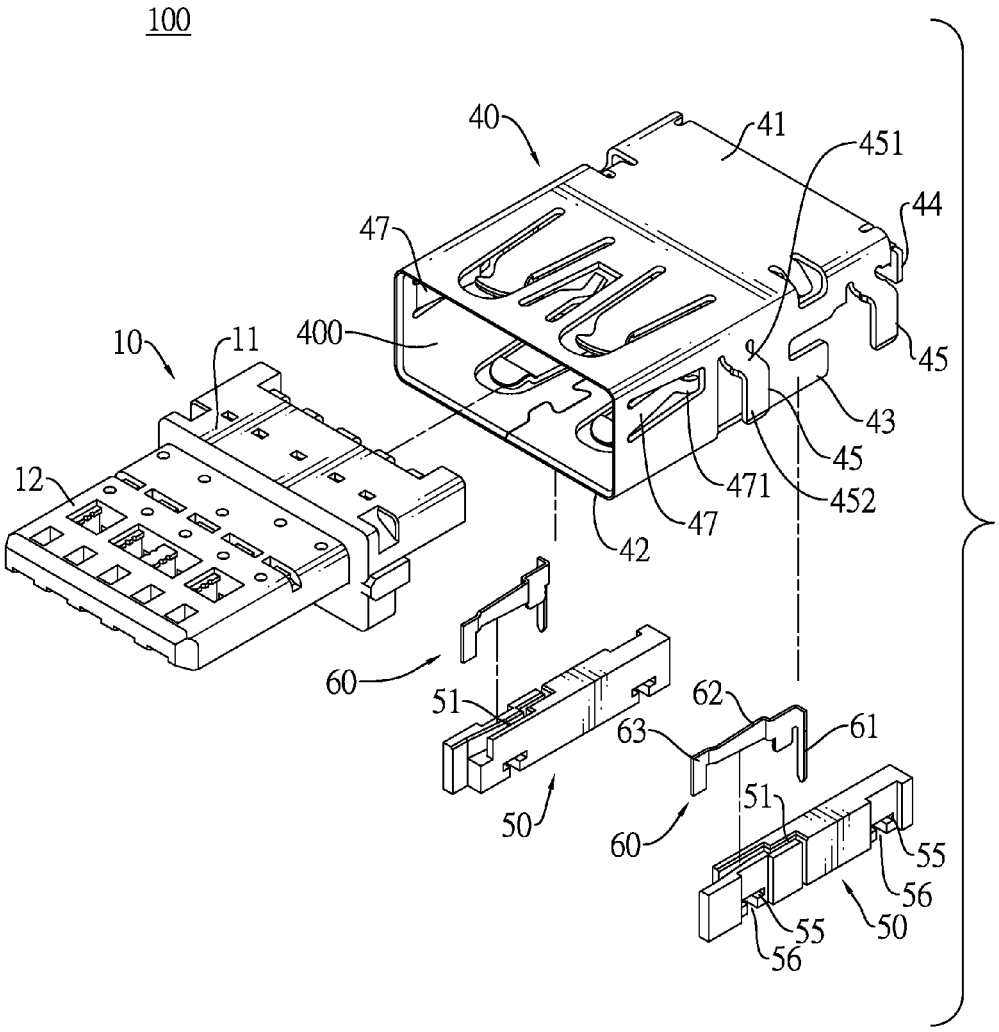
FIG. 10 is an exploded perspective view of the receptacle connector in FIG. 9.
Figure 11:
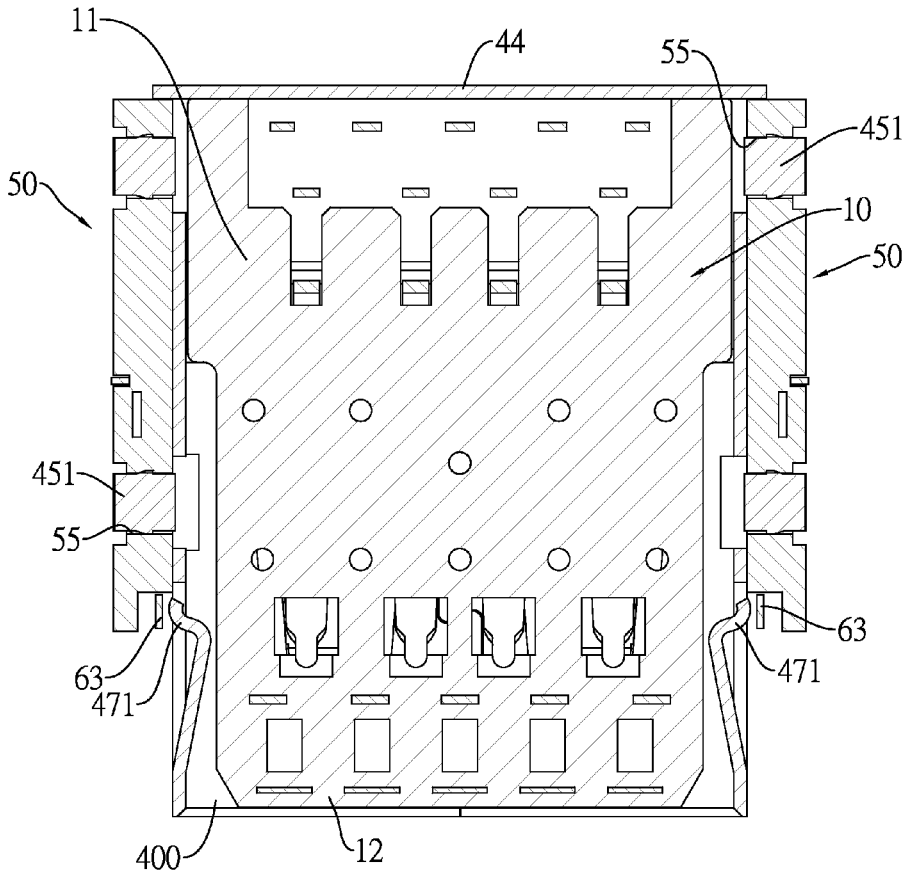
FIG. 11 is a cross sectional top view of the receptacle connector in FIG. 9.

With further reference to FIGS. 9 to 11, a second embodiment of the receptacle connector 100 with detection function is illustrated. In the second embodiment, two detection arms 47 are formed respectively on the sidewalls 43 of the shell 40. Two insulating brackets 50 are mounted respectively outside the sidewalls 43 of the shell 40. Two detection contacts 60 are mounted respectively in the insulating brackets 50 and correspond to the detection arms 47. Two sets of multiple electrical contact mounts 45 are formed respectively on the sidewalls 43 of the shell 40.

The present invention has the following advantages:

1. The detection contact 60 is mounted outside the shell 40 instead of being mounted on the insulator 10. Therefore, the insulator 10 merely needs to combine to the contacts 20, 30 instead of being required to further modify and customize the structure of the insulator 10 with respect to the detection contact 60. Accordingly, the manufacturing process of the insulator 10 is not complicated and may even be simplified to increase the production rate of the receptacle connector 100.

2. The open fixture slot 56 of the insulating bracket 50 may receive a fixture with higher hardness to serve as an anvil, for example, a metal fixture is inserted in the open fixture slot 56. During the fabrication of the insulating bracket 50 to the shell 40, a straight electrical contact mount 45 extends through the through hole 55 of the insulating bracket 50 and then the straight electrical contact mount 45 is pressed against the metal fixture and is bent downward to form a L-shaped electrical contact mount 45, which simultaneously creates the level section 451 and the perpendicular section 452. During the aforementioned bending process, the firmer metal fixture bears and absorbs the bending force to prevent the electrical contact mount 45 from directly pressing against and damaging the through hole 55 of the softer insulating bracket 50.

3. The folding portion 621 of the detection contact 60 is located and fitted inside the corner spaces 511 of the mounting slot 51 of the insulating bracket 50 to position each other to prevent the detection contact 60 from falling out of the mounting slot 51.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A receptacle connector comprising:
an insulator;
multiple contacts located on contact locations of the insulator;
a shell covering the insulator and the contacts and comprising:
a cavity to receive the insulator and the contacts;
two sidewalls; and
a detection arm formed on one of the sidewalls, which is resilient and able to be deformed by external force and recovered after removal of the external force;
an insulating bracket mounted outside of one of the sidewalls of the shell and having a mounting slot defined in the insulating bracket; and
a detection contact mounted in the mounting slot of the insulating bracket and being capable of contacting the detection arm;
wherein the detection arm is capable of bending outward to contact the detection contact due to the external force.

2. The receptacle connector as claimed in claim 1, wherein
the shell further has multiple electrical contact mounts formed on one of the sidewalls and each electrical contact mount has a level section and a perpendicular section formed on and protruding downward from the level section; and
the insulating bracket further has multiple through holes defined through the insulating bracket, and the level sections of the electrical contact mounts are mounted respectively through the through holes.

3. The receptacle connector as claimed in claim 2, wherein
the mounting slot of the insulating bracket has multiple corner spaces;
the detection contact comprises:
a soldering leg mounted through the insulating bracket;
a mounting segment connected to the soldering leg and having multiple folding portions mounted respectively in the corner spaces of the mounting slot of the insulating bracket; and
an electrical contact segment connected to the mounting segment; and
the detection arm of the shell has an electrical contact portion formed on a distal end of the detection arm and selectively contacting the electrical contact segment of the detection contact.

4. The receptacle connector as claimed in claim 3, wherein the insulating bracket further has multiple open fixture slots which are defined in a bottom of the insulating bracket and communicated respectively with the through holes.

5. The receptacle connector as claimed in claim 4, wherein
the insulator has a base and a tongue formed on and protruding forward from the base; and
each contact has a soldering section located behind a rear end of the base and an electrical contact section formed on the soldering section and mounted on the tongue.

6. The receptacle connector as claimed in claim 5, wherein the contacts are classified into multiple first contacts and multiple second contacts located above the first contacts.

7. The receptacle connector as claimed in claim 6, wherein
the shell further has a top plate, a bottom plate and a conductive cap formed on and protruding downward from a rear end of the top plate and covering the soldering sections of the contacts; and
the sidewalls of the shell are formed between the top plate and the bottom plate.

8. A receptacle connector comprising:
an insulator;
multiple contacts mounted on the insulator;
a shell covering the insulator and the contacts and comprising:
a cavity to receive the insulator and the contacts;
two sidewalls; and
two detection arms formed respectively on the sidewalls, which are resilient and able to be deformed by external force and recovered after removal of the external force;
two insulating brackets corresponding to and mounted respectively outside of the sidewalls of the shell and each insulating bracket having a mounting slot defined in the insulating bracket; and
two detection contacts corresponding to and mounted respectively in the mounting slots of the insulating brackets, correspond to the detection arms and being capable of respectively contacting the detection arms;
wherein the detection arms are capable of bending outward to respectively contact the detection contacts due to external force.

9. The receptacle connector as claimed in claim 8, wherein
the shell further has two sets of multiple electrical contact mounts formed respectively on the sidewalls and each electrical contact mount has a level section and a perpendicular section formed on and protruding downward from the level section; and
each insulating bracket further has multiple through holes defined through the insulating bracket, and the level sections of the electrical contact mounts of each set are mounted respectively through the through holes of a corresponding insulating bracket.

10. The receptacle connector as claimed in claim 9, wherein the mounting slot of each insulating bracket has multiple corner spaces;

each detection contact has a soldering leg mounted through the insulating bracket;

a mounting segment connected to the soldering leg and having multiple folding portions mounted respectively in the corner spaces of the mounting slot of a corresponding insulating bracket; and an electrical contact segment connected to the mounting segment; and each detection arm of the shell has an electrical contact portion formed on a distal end of the detection arm and selectively contacting the electrical contact segment of a corresponding detection contact.

* * * * *